US012528621B2

(12) United States Patent
Mäkelä

(10) Patent No.: US 12,528,621 B2
(45) Date of Patent: Jan. 20, 2026

(54) LID FOR A BEVERAGE CUP AND A METHOD FOR MANUFACTURING THE LID

(71) Applicant: CREATIVE OY, Ikaalinen (FI)

(72) Inventor: Jarno-Pekka Mäkelä, Ikaalinen (FI)

(73) Assignee: CREATIVE OY, Ikaalinen (FI)

( * ) Notice: Subject to any disclaimer, the term of this patent is extended or adjusted under 35 U.S.C. 154(b) by 0 days.

(21) Appl. No.: 18/687,460

(22) PCT Filed: Sep. 1, 2021

(86) PCT No.: PCT/FI2021/050589

§ 371 (c)(1),
(2) Date: Feb. 28, 2024

(87) PCT Pub. No.: WO2023/031499

PCT Pub. Date: Mar. 9, 2023

(65) Prior Publication Data

US 2024/0359873 A1 Oct. 31, 2024

(51) Int. Cl.
*B65D 43/02* (2006.01)
*A47G 19/22* (2006.01)

(52) U.S. Cl.
CPC ..... *B65D 43/02* (2013.01); *A47G 19/22* (2013.01)

(58) Field of Classification Search
CPC .. B65D 43/02; B65D 43/0202; B65D 47/043; B65D 19/22; B65D 19/2272
USPC ..... 220/200
See application file for complete search history.

(56) References Cited

U.S. PATENT DOCUMENTS

| | | | | |
|---|---|---|---|---|
| 4,331,255 | A * | 5/1982 | Fournier | B65D 51/18 220/270 |
| 6,488,173 | B2 * | 12/2002 | Milan | A47G 19/2272 220/255 |
| 8,267,275 | B2 * | 9/2012 | Peitersen | B65D 47/06 229/404 |
| 8,734,874 | B1 * | 5/2014 | Paolone | A23F 5/243 220/254.1 |
| 11,577,908 | B2 * | 2/2023 | Duman | A47G 19/16 |
| 2021/0198014 | A1 * | 7/2021 | Zhu | B65D 77/206 |

OTHER PUBLICATIONS

International Search Report and Written Opinion dated May 13, 2022 for PCT Application No. PCT/FI2021/050589, 18 pages.

* cited by examiner

*Primary Examiner* — Javier A Pagan
(74) *Attorney, Agent, or Firm* — Pierce Atwood LLP; Christopher A. Baxter

(57) ABSTRACT

A lid (I) for a beverage cup (2) and a method for manufacturing the lid (I) are disclosed hereinafter. The lid (I) is made of multiple parts that form a chamber between a top (20) and a base (IO). At least portion of the parts are made of coated paperboard. The parts are connected by melting the coating of two abutting parts together. The base (IO) and the top (20) have openings (11, 12) that allow the user to drink the beverage through the lid (I). The chamber (14) provides resistance to splashes as the liquid passes through the lid (I).

6 Claims, 19 Drawing Sheets

| | |
|---|---|
| Sealed surfaces: | A 295 gsm and B 280gsm + coated side/thicker coating layer, - uncoated side/ thinner coating layer |

| Standard / Method: | Hot Air Sealer | | | | | | | |
|---|---|---|---|---|---|---|---|---|
| | Sealing force (N): | 400 | Pressing parts: | | Adhesion value: | Description: | | |
| | Heating time (s): | 1,5 | Length (mm): | 150 | 0 | No seal | 4 | Over 90% fibre tear |
| | Open time (s): | 0 | Width (mm): | 3 | 1 | Weak adhesion | 4,5 | Over 90% fibre tear |
| | Sealing temperature (°C): | 350 | | | 2 | Adhered but no tear | 5 | 100% fibre tear |
| | Network pressure (bar): | 6 | | | 3 | Under 50% fibre tear | | |

| Sample size: | 105 mm (W) x 155 mm CD (sealed area 105 mm x 3 mm) |
|---|---|

Adhesion value:

| Pressing time(), 5s | | Pressing time 1,0s | | Pressing time 1,5s | | Pressing time 1,9s | | | |
|---|---|---|---|---|---|---|---|---|---|
| B + vs. B - | 5/ 5/ 5 | B + vs. B - | 5/ 5/ 5 | B + vs. B - | 5/ 5/ 5 | B + vs. B - | 5/ 5/ 5 | | |
| B - vs. B - | 5/ 5/ 5 | B - vs. B - | 5/ 5/ 5 | B - vs. B - | 5/ 5/ 5 | B - vs. B - | 5/ 5/ 5 | | |
| A - vs. B - | 5/ 5/ 5 | A - vs. B - | 5/ 5/ 5 | A - vs. B - | 5/ 5/ 5 | A - vs. B - | 5/ 5/ 5 | | |

Fig. 31

Sealed surfaces: A 295 gsm and B 280 gsm; + coated side/ thicker coating layer, - uncoated side/ thinner coating layer Method: KOPP Laboratory Sealer SGPE20

| | | Adhesion value: | Description: | | |
|---|---|---|---|---|---|
| Sealing time (s): | varied | 0 | No seal | 4 | Over 50% fibre tear |
| Sealing pressure (N): | 400 | 1 | Weak adhesion | 4,5 | Over 90% fibre tear |
| Length of pressing part (mm): | 100 | 2 | Adhered but no fibre tear | 5 | 100% fibre tear |
| Width of pressing part (mm): | 10 | 3 | Under 50% fibre tear | | |

Both parts were heated

Result: The lowest temperature that was needed for the perfect adhesion

Sample size: ≈ 150 mm MD x ≈ 70 mm CD (1/6 of A4)

Measurement date: 12.4.2021

Sealing temperature (max. 300°C):

| Sealing time 0,5s | 100°C | 110°C | 120°C | 130°C | 140°C | 150°C | 160°C | 170°C | °C | °C | °C | °C | Result: |
|---|---|---|---|---|---|---|---|---|---|---|---|---|---|
| B - vs. B - | 0 | 0 | 0 | 4/4 | 5/5/5 | | | | | | | | 140°C |
| A + vs. B - | 0 | 0 | 0 | 3/2 | 5/5/5 | | | | | | | | 140°C |
| A - vs. B - | | 0 | 0 | 1 | 2 | 4/3 | 4/4 | 5/5/5 | | | | | 170°C |
| **Sealing time 0,3s** | **150°C** | **160°C** | **170°C** | **180°C** | **190°C** | **200°C** | **210°C** | **°C** | **°C** | **°C** | **°C** | **°C** | |
| B - vs. B - | 1 | 3 | 4 | 5/5/5 | | | | | | | | | 180°C |
| A + vs. B - | 3 | 4 | 5/5/5 | | | | | | | | | | 170°C |
| A - vs. B - | | | | 2 | 3 | 3 | 5/5/5 | | | | | | 210°C |
| **Sealing time 0,3s** | **190°C** | **200°C** | **210°C** | **220°C** | **230°C** | **240°C** | **250°C** | **260°C** | **270°C** | **280°C** | **290°C** | **300°C** | |
| B - vs. B - | 1 | 2 | 2 | 3 | 3 | 3 | 3 | 4 | 4 | 4,5/4,5 | 5/5/5 | | 290° |
| A + vs. B - | 1 | 2 | 3 | 3 | 3 | 4 | 4,5/4,5 | 5/5/5 | | | | | 280° |
| A - vs. B - | | | | | | | 2 | 1 | 2 | 2 | 2 | 3/3 | |

Sealed surfaces: A 295 gsm and B 280 gsm; + coated side/ thicker coating layer, - uncoated side/ thinner coating layer Method: KOPP Laboratory Sealer

| | | Adhesion value: | Description: | | |
|---|---|---|---|---|---|
| Sealing time (s): | varied | 0 | No seal | 4 | Over 50% fibre tear |
| Sealing pressure (N): | -398 | -797 | Weak adhesion | 4,5 | Over 90% fibre tear |
| Length of pressing par | -96 | -194 | Adhered but no fibre | 5 | 100% fibre tear |
| Width of pressing par | -8 | -11 | Under 50% fibre tear | | |
| Both parts were heat | | | | | |

Result: The lowest temperature that was needed for the perfect adhesion

Sample size: ≈ 150 mm MD x ≈ 70 mm CD (1/6 of A4)

Measurement date: 13.4.2021

Sealing temperature (max. 300°C):

| Sealing time 0 | 100°C | 110°C | 120°C | 130°C | 140°C | 150°C | 160°C | 170°C | °C | °C | °C | °C | Result: |
|---|---|---|---|---|---|---|---|---|---|---|---|---|---|
| B - vs. B - | 0 | 0 | 0 | 4/5 | 5/5/5 | | | | | | | | 140°C |
| A + vs. B - | 0 | 0 | 0 | 3/3 | 5/5/5 | | | | | | | | 140°C |
| A - vs. B - | 0 | 0 | 0 | 1 | 2 | 4/5 | 4/6 | 5/5/6 | | | | | 170°C |
| **Sealing time 0** | **150°C** | **160°C** | **170°C** | **180°C** | **190°C** | **200°C** | **210°C** | **°C** | **°C** | **°C** | **°C** | **°C** | |
| B - vs. B - | 1 | 3 | 4 | 5/5/6 | | | | | | | | | 180°C |
| A + vs. B - | 2 | 3 | 5/5/6 | | | | | | | | | | 170°C |
| A - vs. B - | | | | 2 | 3 | 3 | 5/5/6 | | | | | | 210°C |
| **Sealing time 0** | **190°C** | **200°C** | **210°C** | **220°C** | **230°C** | **240°C** | **250°C** | **260°C** | **270°C** | **280°C** | **290°C** | **300°C** | |
| B - vs. B - | 1 | 2 | 2 | 3 | 3 | 3 | 3 | 4 | 4 | 4,5/4,6 | 5/5/6 | | 290° |
| A + vs. B - | 1 | 2 | 3 | 3 | 3 | 4 | 4,5/4,6 | 5/5/6 | | | | | 280° |
| A - vs. B - | | | | | | | 1 | 1 | 2 | 2 | 2 | 3/4 | |

Fig. 32

| | |
|---|---|
| Sealed surfaces: | KM Isla A 295gsm and Isla B 280gsm; + coated side/ thicker coating layer, - uncoated side/ thinner coating layer |

| Standard / Method: | | | | | | | |
|---|---|---|---|---|---|---|---|
| Ultrasonic welder Rinco MP202 | | | | | | | |
| Trigger: | 5,7 | Value: | Description: | Value: | Description: | Adh. = The value of adhesion (0-5) | |
| Pressure (bar): | 3 | 0 | No adhesion | 4 | Over 50% fibre tear | Ws = the used energy when sealed (Ws) | |
| Amplitude: | 8 | 1 | Weak adhesion | 4,5 | Over 90% fibre tear | | |
| Hold time (s): | 0,5 | 2 | Adhered but no clear tear | 5 | 100% fibre tear | | |
| Pressing area (length / width): 50 mm / 8 mm | | 3 | Under 50% fibre tear | | | | |

| Weld time (s): | 0,2 | 0,2 | 0,2 | 0,25 | 0,25 | 0,25 | 0,3 | 0,3 | 0,3 | Result (s): |
|---|---|---|---|---|---|---|---|---|---|---|
| Samples | Adh./Ws | Adh./Ws | Adh./Ws | Adh./Ws | Adh./Ws | Adh./Ws | Adh./Ws | Adh./Ws | Adh./Ws | The shortest time that was needed for the perfect adhesion |
| A + vs B - | 3/ 85 | 3/ 81 | 3/ 84 | 4,5/ 129 | 4,5/ 130 | 4,5/ 126 | 5/ 162 | 5/ 174 | 5/ 174 | 0,3 |
| B - vs B - | 4/ 89 | 4/ 88 | 4/ 90 | 5/ 137 | 4,5/ 134 | 4,5/ 133 | 5/ 179 | 5/ 181 | 5/ 178 | 0,3 |
| B + vs B + | 4/ 88 | 4/ 88 | 4/ 89 | 5/ 139 | 5/ 138 | 4,5/ 136 | 5/ 182 | 5/ 181 | 5/ 183 | 0,3 |
| B + vs B - | 4/ 87 | 4/ 91 | 4/ 88 | 5/ 137 | 4,5/ 131 | 4,5/ 132 | 5/ 177 | 5/ 180 | 5/ 181 | 0,3 |
| A + vs B + | 3/ 82 | 4/ 87 | 3/ 82 | 4,5/ 126 | 5/ 129 | 4,5/ 133 | 5/ 174 | 5/ 171 | 5/ 174 | 0,3 |
| A + vs A - | 3/ 82 | 3/ 81 | 3/ 83 | 4,5/ 119 | 4,5/ 128 | 4,5/ 125 | 5/ 167 | 5/ 162 | 5/ 170 | 0,3 |

Fig. 33

LID FOR A BEVERAGE CUP AND A METHOD FOR MANUFACTURING THE LID

CROSS-REFERENCE TO RELATED APPLICATIONS

This application is a National Stage 371 application claiming the benefit of International Application No. PCT/FI2021/050589, filed Sep. 1, 2021, the entire contents of which are incorporated herein by reference.

BACKGROUND

The invention relates to lids for disposable beverage cups.

Takeaway beverages such as hot coffees or cold soft drinks are often covered with lids. The lid provides protection against spillage. Some lids comprise an opening to enable drinking through the lid. In one exemplary scenario, a person purchases a cup of hot coffee from a petrol station, with the intent of consuming the hot coffee while driving. As the car is moving over bumps and potholes, the coffee may splash inside the cup, causing the coffee to flood surprisingly through the opening. The user may receive uncomfortable amount of hot coffee at once.

Humans perceive taste of the beverage partially by smelling it. As the user drinks the coffee through the lid, the scent of coffee may not be perceived. The user may however, smell the residual scent of the lid or the cup.

SUMMARY

This summary is provided to introduce a selection of concepts in a simplified form that will be further described below in the detailed description. This summary is intended to neither identify key features or essential features of the claimed subject matter nor to be used to limit the scope of the claimed subject matter. Furthermore, the claimed subject matter is not limited to implementations that solve any or all of the disadvantages noted in any part of this disclosure.

A lid for a beverage cup and a method for manufacturing the lid are disclosed hereinafter. The lid is made of multiple parts that form a chamber between a top and a base. At least portion of the parts are made of coated paperboard. The parts are connected by melting the coating of two abutting parts together. The melting may be activated by pressure, applying heat and pressure to the joint, hot air sealing, hot bar sealing, hot roll sealing, impulse heat sealing, ultrasonic sealing, radiation sealing, high frequency sealing, gas flame sealing or any other method configured to quickly release thermal energy to the abutting coatings.

The base and the top have openings that allow the user to drink the beverage through the lid. The chamber provides resistance to splashes as the liquid passes through the lid. The effectiveness of the splash resistance may be adjusted by selecting appropriate openings to the base and to the top. For example, the opening at the base may be smaller to limit the flow of the liquid through the lid. Consequently, larger opening at the top may be more comfortable for the user.

In one embodiment, the chamber comprises an infusion material or other substance. For example, flavours or nutrients may be placed in the chamber. The chamber may be sealed prior to use as the user may tear off covers at the top and/or the base before placing the lid onto the cup. One example of infusion material is tea. The substance may be quickly dissolving material that reacts to water or other liquid, and provides the best results after short application of water or other liquid. In one example the substance is instant noodles, that may be applied to hot water for a relatively short period of time. The lid and the chamber may be used to prepare instant noodles. In one use case, the opening of the base is opened first to allow the liquid from the cup to infuse the substance. The opening at the top may be opened at the last stage to enable consuming the infused substance.

The coated paperboard may be a coated barrier board or a water-based dispersion coating. The coating may comprise at least one substance from the group of polyethylene, low density polyethylene, biopolyethylene, microfibrillated cellulose, polyhydroxyalkanoate and polylactic acid.

In one embodiment the top has at least two openings, one for consuming the beverage and one opening at the other side of the top, near user's nose. When the user is drinking though the lid, the second opening allows air to pass through a second breather opening. The opening near user's nose allows also scent of the beverage to be smelled, thereby improving the drinking experience.

Many of the attendant features will be more readily appreciated as they become better understood by reference to the following detailed description considered in connection with the accompanying drawings. The embodiments described below are not limited to implementations which solve any or all the disadvantages of known lids or beverage cups.

BRIEF DESCRIPTION OF THE DRAWINGS

The present description will be better understood from the following detailed description read in light of the accompanying drawings, wherein

FIG. 31 illustrates a table comprising test results for connecting two abutting paperboard surfaces by hot air sealing;

FIG. 32 illustrates a table comprising test results for connecting two abutting paperboard surfaces by hot bar sealing; and FIG. 33 illustrates a table comprising test results for connecting two abutting paperboard surfaces by ultrasonic welding.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. However, the same or any equivalent functions and sequences may be accomplished by different examples.

Although the present examples are described and illustrated herein as being implemented in a disposable coffee cup and a disposable lid, they are provided as an example and not a limitation. As those skilled in the art will appreciate, the present examples are suitable for application in a variety of different types of cups or beverages.

In the following, directions such as up, down, horizontal, vertical, etc., are defined by the conventional use direction of cups and in the context of lids the directions are defined as the lid is placed on the cup.

Figure 1:
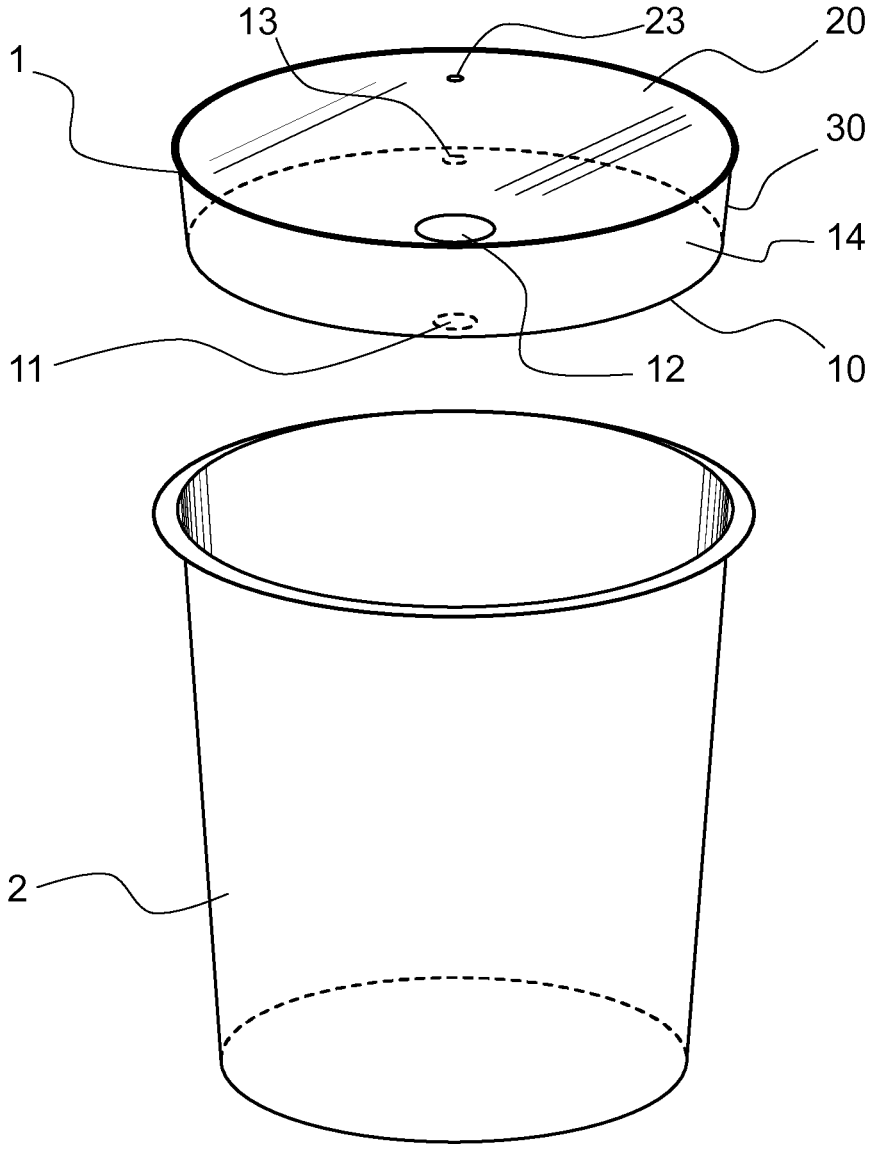
FIG. 1 illustrates schematically an isometric view of one exemplary embodiment of a lid and a cup.

FIG. 1 illustrates schematically an isometric view of one exemplary embodiment of the lid 1 and the beverage cup 2. The beverage cup 2 is in this example a disposable cup for hot beverages, such as coffee. A base 10, a top 20 and a sidewall 30, define a chamber 14 inside the lid 1. In this example, the top 20 appears transparent for illustrative purposes, although the top 20 material may be typically opaque. The sidewall 30 is connected to the circumference of the top 20 and the base 10. In some embodiments, the top 20 may be partially folded to form at least part of the sidewall 30. In some embodiments, the base 10 may be partially folded to form at least part of the sidewall 30.

The base 10 comprises a first opening 11 and the top 20 comprises a second opening 12. When the lid 1 is placed tightly on the beverage cup 2, the beverage is configured to flow from the beverage cup 2, through the lid's 1 first opening 11, via the chamber 14 and through the second opening 12 to the user drinking the beverage. The second opening 12 is near the edge of the top 10 or at the edge of the top 10. As the user tilts the beverage cup 2, the beverage flows first towards the lowest edge of the tilted top 10. The first opening 11 may be at the same vertical axis as the second opening 12, helping the user to pour all beverage from the cup 2 with a single tilt.

In one embodiment, the base 10 comprises a first breather opening 13 at a distal edge from the first opening 11. When the cup 2 is tilted, the beverage flows through the first opening 11. At the same time, air flows into the cup through the first breather opening 13. The first breather opening 13 reduces splashing inside the chamber 14.

In one embodiment, the top 10 comprises a second breather opening 23 at a distal edge from the second opening 12, near a user's nose when the user is drinking though the lid 1. The second breather opening 23 is configured to allow air to pass through the second breather opening 23. Also, the user may smell the beverage better through the second breather opening 23. The scent provides improves experience for the user, as the aroma is partially experienced through the taste and partially through the scent. For example, hot coffee provides satisfactory scent to many users. When the cup 2 is tilted, the air flows into the chamber 14 via the second breather opening 23.

Figure 2:
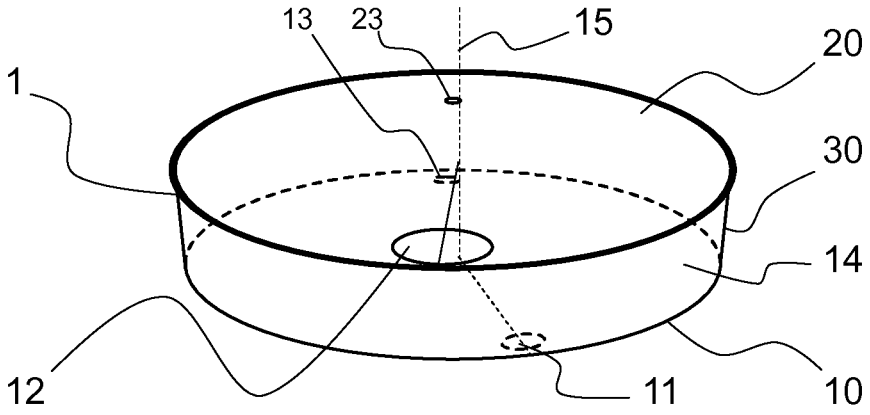
FIG. 2 illustrates schematically an isometric view of one exemplary embodiment of the lid.

In one embodiment, the first opening 11 and the second opening 12 hinder the flow of the beverage to provide the lid 1 splash-resistant functionality. In one embodiment, the first opening 11 is smaller than the second opening 12, thereby reducing the speed of the beverage at the chamber 14. The second opening 12 may be suitable size to provide comfortable contact to user's lips. In one embodiment, as illustrated in FIG. 2 the lid 1 comprises a vertical axis 15 along the base 10 and the top 20. The first opening 11 and the second opening 12 are at different positions along the vertical axis 15. In one embodiment, the first opening 11 and the second opening 12 are partially aligned along the vertical axis 15. In one embodiment, the first breather opening 13 and/or the second breather opening 22 positioned at the central region of the lid 1.

The lid 1 is made of coated paperboard, or the lid 1 comprises coated paperboard as one of the constructional elements. In one embodiment, the lid 1 is made of coated foam formed cellulose sheet. In one embodiment, the lid 1 is made of coated foam formed paper. In one embodiment, the lid 1 is made of coated pulp paper. In one embodiment, the sidewall 30 is connected to the base 10 by a melted coating of the paperboard. In one embodiment, the sidewall 30 is connected to the top 10 by the melted coating of the paperboard. In one embodiment, the coated paperboard comprises a coated barrier board. In one embodiment, the coated barrier comprises a water-based dispersion coating. The coating comprises at least one substance from the group of polyethylene, low density polyethylene, biopolyethylene, microfibrillated cellulose, polyhydroxyalkanoate and polylactic acid. The melted coating provides an adhesive suitable for keeping the components of a hand-held disposable beverage cup 2 together. In one embodiment, the melted coating is suitable for hot beverages. In one embodiment, the melted coating is suitable for cold beverages, wherein the definition of hot or cold are made by human mouth. In one embodiment the barrier board comprises a dispersion barrier. In one embodiment the barrier board comprises a polyethylene barrier layer made of plant-based raw material. In one embodiment the barrier board comprises a multilayer ethylene-vinyl alcohol copolymer and polyethylene polymer structure.

The method for heating the coating may be friction, pressure, applying heat and pressure to the joint, hot air sealing, hot bar sealing, hot roll sealing, impulse heat sealing, ultrasonic sealing, radiation sealing, high frequency sealing, gas flame sealing or any other method configured to quickly release thermal energy to the abutting coatings.

In one example the method for connecting two abutting surface comprise hot air sealing. Examples of tested parameters suitable for achieving sufficient contact are illustrated in FIG. 31, a table of test results wherein the hot air sealing was tested with various pressing times. The hot air sealing was tested at a temperature of 350° C. Typically, temperatures used for the hot air sealing are higher than for the hot bar sealing as air does not conduct heat as well as a solid object, i.e. the hot bar. As FIG. 31 illustrates, sufficient contact was achieved for all tested parameters. In this example, the coatings are water-based dispersion coatings.

In one example the method for connecting two abutting surface comprise hot bar sealing. Examples of tested parameters suitable for achieving sufficient contact are illustrated in FIG. 32, a table of test results wherein the hot bar sealing was tested with various pressing times. FIG. 32 illustrates the optimal parameters for achieving sufficient contact between different surfaces by hot bar sealing. Achieving sufficient contact between two surfaces is a function of time and applied temperature. The temperature range for achieving sufficient contact between different surfaces at a sealing time of 0.5 s is between 140° C. and 170° C. The temperature range for achieving sufficient contact between different surfaces at the sealing time of 0.3 s is between 170° C. and 210° C. The temperature range for achieving sufficient contact between different surfaces at the sealing time of 0.3 s is between 170° C. and 210° C. The temperature range for achieving sufficient contact between different surfaces at the sealing time of 0.1 s is between 260° C. and 290° C. In this example, the coatings are water-based dispersion coatings. For polyethylene-based coatings the temperatures are typically 50° C. higher than for water-based dispersion coatings.

In one example the method for connecting two abutting surface comprise ultrasonic welding. Examples of tested parameters suitable for achieving sufficient contact are illustrated in FIG. 33, a table of test results wherein the ultrasonic welding was tested with various weld times. FIG. 33 illustrates the optimal parameters for achieving sufficient contact between different surfaces by ultrasonic welding.

In this context melting refers to the coating changing temporarily its phase from solid to liquid. According to the conducted tests, in some embodiments the coating may soften from the solid phase in order to achieve sufficient adhesion with the abutting surface. In some embodiments, the abutting surface is uncoated paperboard, wherein the melted coating of one surface provides sufficient adhesion to the uncoated surface. Melting changes the surface characteristics of the paperboard temporarily. The melted joint holds liquid beverages after it has been cooled.

Figure 3:
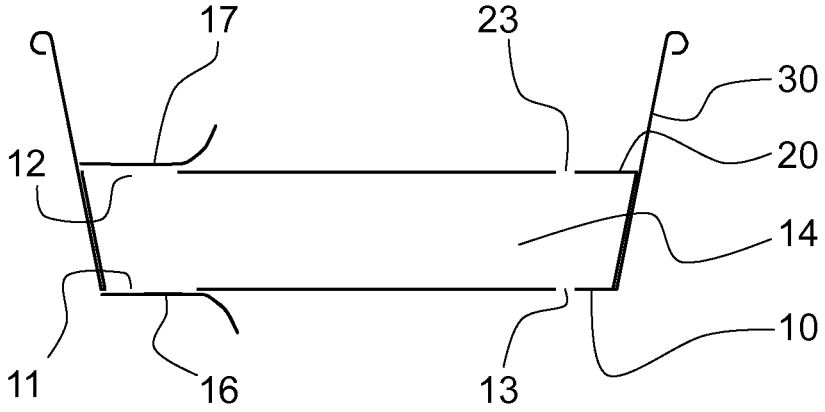
FIG. 3 illustrates schematically a cross-sectional view of one exemplary embodiment of the lid.

FIG. 3 illustrates schematically a cross-sectional view of one exemplary embodiment of the lid 1. In this example, the first opening 11 of the base 10 is covered by a first tear-off cover 16. The first tear-off cover 16 is in one embodiment connected to the base 10 by having the coatings melted together. In one embodiment, the first tear-off cover 16 is perforated into the base 10. The first tear-off cover 16 may comprise a lip that extends outside the sidewall 30. In this example, the second opening 12 of the top 20 is covered by a second tear-off cover 17. The second tear-off cover 17 is in one embodiment connected to the top 20 by having the coatings melted together. In one embodiment, the second tear-off cover 17 is perforated into the top 20. The second tear-off cover 17 may comprise a lip that extends outside the sidewall 30. In one embodiment, the lid 1 comprises only the first tear-off cover 16. In one embodiment, the lid 1 comprises only the second tear-off cover 17.

Figure 4:
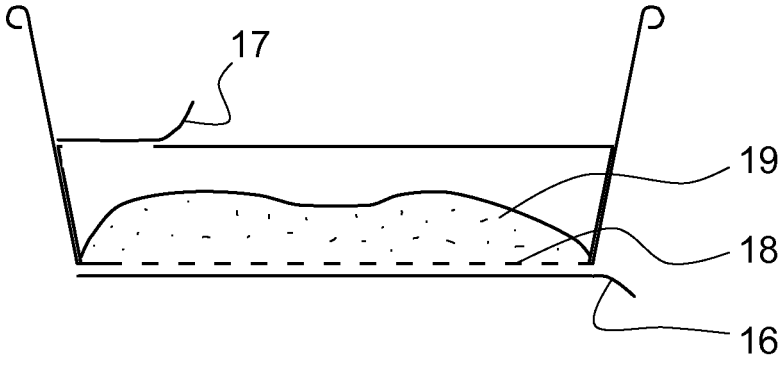
FIG. 4 illustrates schematically a cross-sectional view of one exemplary embodiment of the lid.

FIG. 4 illustrates schematically a cross-sectional view of one exemplary embodiment of the lid 1. In this example, the chamber 14 comprises an infusion material 19 or other substance for the beverage configured to flow though the chamber 14. In this example, the first opening 10 is a mesh 18. The base 10 comprises the mesh 18 configured to allow liquid from the beverage cup 2 to pass through the base 10. In this example, the first tear-off cover 16 is provided to protect the infusion material prior to its use. The substance may be nutritious material, solid or semisolid material suitable to be consumed with the beverage. In one example the beverage is cold water. In one example the beverage is hot water. The second tear-off cover 17 may be used to provide additional time for the beverage and the infusion material and/or the substance to react together. For that purpose, the cup 2 and the lid 1 may be turned upside down.

FIGS. 5-27 illustrate schematically alternative embodiments of the lid 1. The embodiments illustrate the connections between the base 10, the top 20 and the sidewall 30. The first opening 11, the second opening 12, the first breather 13 and the second breather 23 are omitted from the FIGS. 5-27. The base 10 may provide at least a portion of the sidewall 30. The top 20 may provide at least a portion of the sidewall 30. Various details of the illustrated examples may be implemented as combinations providing new alternative embodiments that are not illustrated in FIGS. 5-27.

Figure 5:
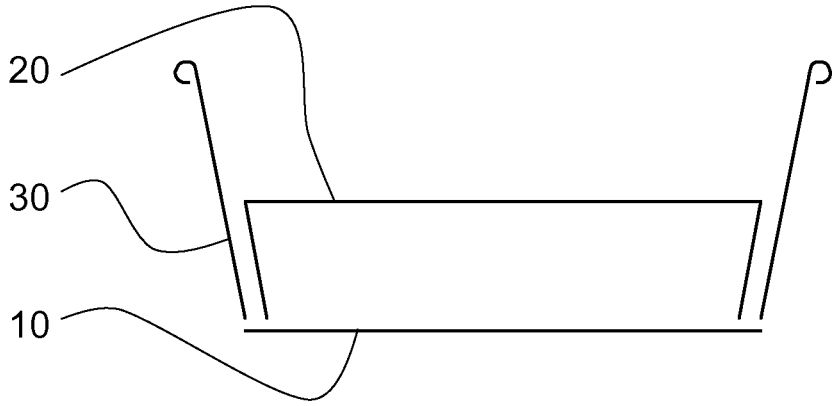
FIG. 5 illustrates schematically a cross-sectional view of one exemplary embodiment of the lid.

FIG. 5 illustrates schematically a cross-sectional view of one exemplary embodiment of the lid 1. In this example, the top 20 is connected to the sidewall 30 by having an outer perimeter of the top 20 folded down and having an outer surface coating of the top's outer perimeter melted together with an inner surface coating of the sidewall 30. The outer perimeter may be defined as portion of the paperboard near the edge, when the base 10, the top 20 or the sidewall 30 has not yet been connected to the lid 1. The outer perimeter may comprise extensions and shapes suitable for providing connection between abutting surfaces. The folding may be executed by a suitable jig configured to press the paperboard into desired shape. The base 10 is connected to the lid 1 by having an edge surface facing down of the connected top 20 and sidewall 30 coating melted together with an upper coating of the base's outer perimeter. The top 10 provides portion of the sidewall 30, thereby stiffing the structure of the lid 1.

Figure 6:
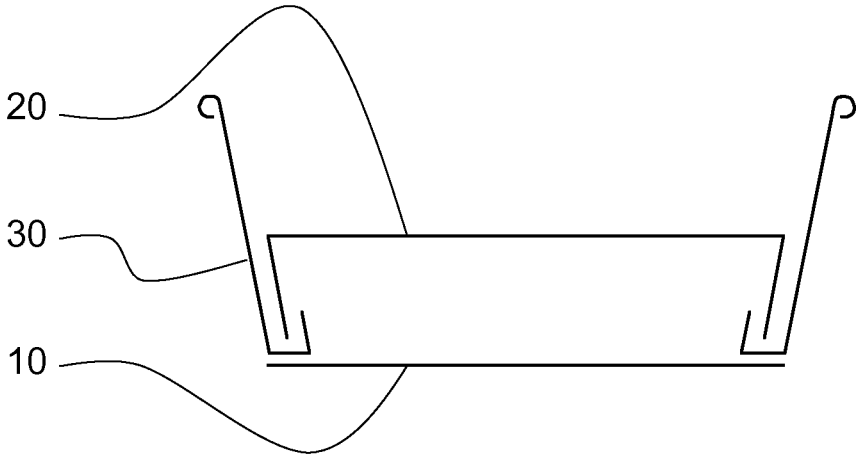
FIG. 6 illustrates schematically a cross-sectional view of one exemplary embodiment of the lid.

FIG. 6 illustrates schematically a cross-sectional view of one exemplary embodiment of the lid 1. In this example, the top 20 is connected to the sidewall 30 by having the outer perimeter of the top 20 folded down and having the outer surface coating of the top's outer perimeter melted together with the inner surface coating of the sidewall 30. A bottom portion of the sidewall 30 is folded around an edge of an outer perimeter of the top 20 facing down. In one embodiment, the top 20 is first melted together with the sidewall 30 and the curve around the bottom edge of the top 20. In one embodiment, the curve is pressed to turn around the bottom edge of the top 20 the connection is secured by melting the top 20 melted together with the sidewall 30. The base 10 is connected to the lid 1 by having a sidewall 30 surface coating facing down melted together with an upper portion of an outer perimeter surface coating of the base 10.

Figure 7:
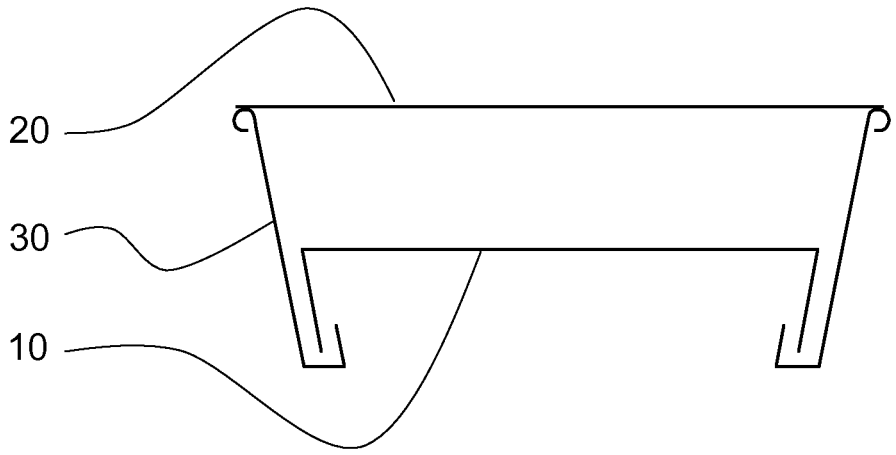
FIG. 7 illustrates schematically a cross-sectional view of one exemplary embodiment of the lid.

FIG. 7 illustrates schematically a cross-sectional view of one exemplary embodiment of the lid 1. In this example, the base 10 is connected to the sidewall 30 by having an outer perimeter of the base 10 folded down and having an outer surface coating of the base's outer perimeter melted together with the inner surface coating of the sidewall 30. The bottom portion of the sidewall 30 is folded around the edge of the outer perimeter of the base 10 facing down. The top 20 is connected to the lid 1 by having an upper edge of the sidewall 30 rolled and having a sidewall 30 surface coating facing up melted together with a lower outer perimeter surface coating of the top 20.

Figure 8:
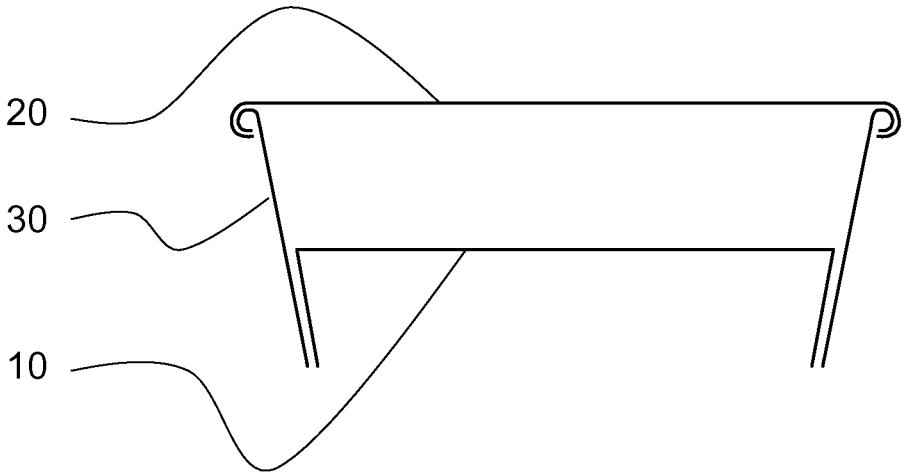
FIG. 8 illustrates schematically a cross-sectional view of one exemplary embodiment of the lid.

FIG. 8 illustrates schematically a cross-sectional view of one exemplary embodiment of the lid 1. In this example, the base 10 is connected to the sidewall 30 by having the outer perimeter of the base 10 folded down and having the outer surface coating of the base's outer perimeter melted together with the inner surface coating of the sidewall 30. The top 20 is connected to the lid 1 by having an upper edge of the sidewall 30 rolled together with an outer perimeter of the top 20.

Figure 9:
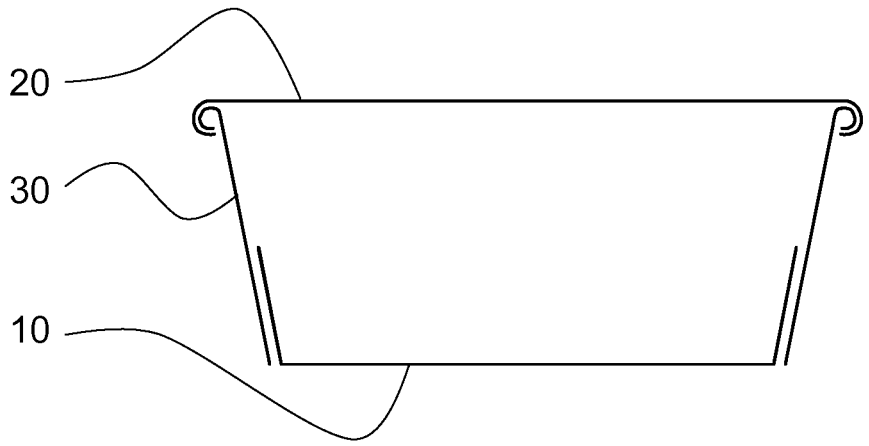
FIG. 9 illustrates schematically a cross-sectional view of one exemplary embodiment of the lid.

FIG. 9 illustrates schematically a cross-sectional view of one exemplary embodiment of the lid 1. In this example, the base 10 is connected to the sidewall 30 by having the outer perimeter of the base 10 folded up and having the outer surface coating of the base's outer perimeter melted together with the inner surface coating of the sidewall 30. The top 20 is connected to the lid 1 by having an upper edge of the sidewall 30 rolled together with an outer perimeter of the top 20.

Figure 10:
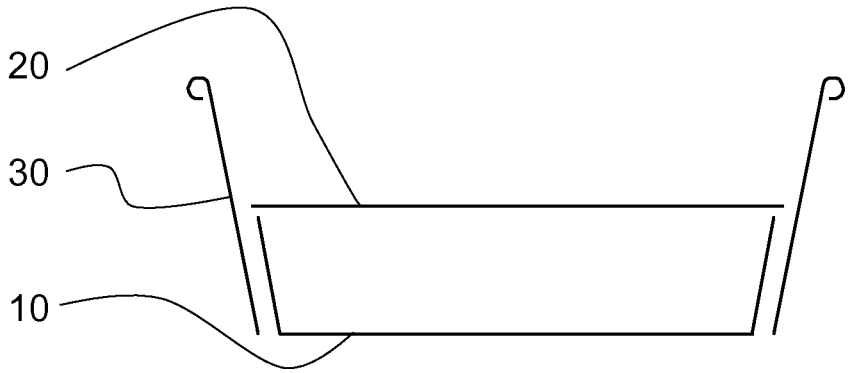
FIG. 10 illustrates schematically a cross-sectional view of one exemplary embodiment of the lid.

FIG. 10 illustrates schematically a cross-sectional view of one exemplary embodiment of the lid 1. In this example, the base 10 is connected to the sidewall 30 by having the outer perimeter of the base 10 folded up and having the outer surface coating of the base's outer perimeter melted together with the inner surface coating of the sidewall 30. The top 20 is connected to the lid 1 by having an upper edge of the base 10 melted together with an outer perimeter of the top 20.

Figure 11:
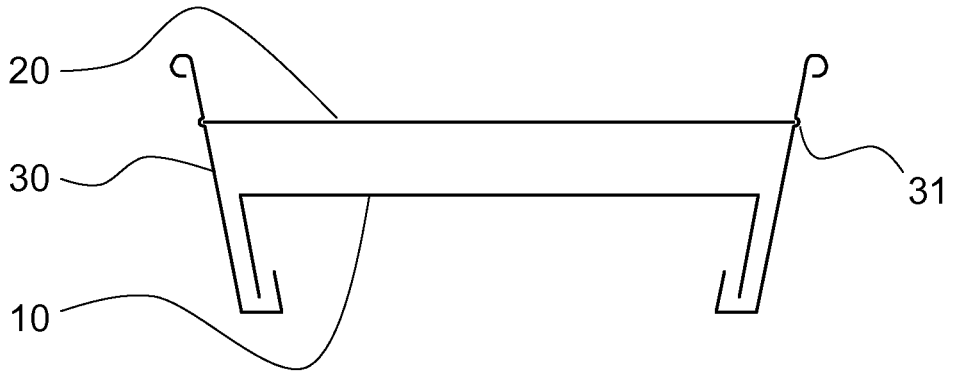
FIG. 11 illustrates schematically a cross-sectional view of one exemplary embodiment of the lid.

FIG. 11 illustrates schematically a cross-sectional view of one exemplary embodiment of the lid 1. In this example, the base 10 is connected to the sidewall 30 by having an outer perimeter of the base 10 folded down and having an outer surface coating of the base's outer perimeter melted together with an inner surface coating of the sidewall 30. The bottom portion of the sidewall 30 is folded around the edge of the outer perimeter of the base 10 facing down. The sidewall 30 comprises a rolled upper edge. The sidewall 30 comprises a circumferential extension 31 parallel to the base 10 at a position between the rolled upper edge and the bottom portion. The position may be selected to provide sufficient volume, shape and/or effect to the chamber 14. The top 20 is connected to the lid 1 by having an inner surface coating of the circumferential extension melted together with the outer perimeter surface coating of the top 20.

Figure 12:
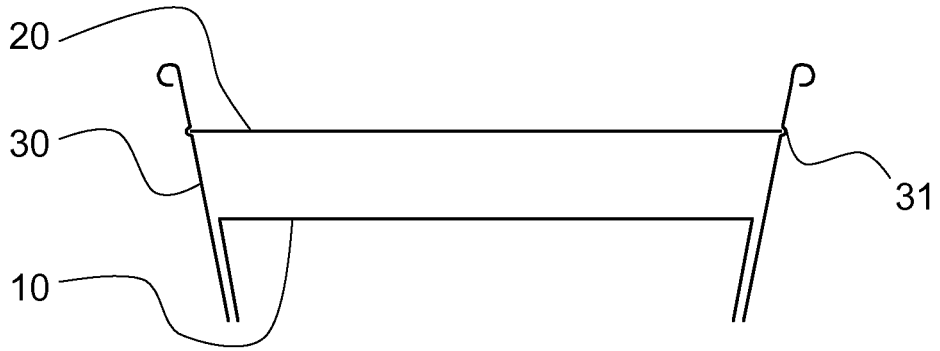
FIG. 12 illustrates schematically a cross-sectional view of one exemplary embodiment of the lid.

FIG. 12 illustrates schematically a cross-sectional view of one exemplary embodiment of the lid 1. In this example, the base 10 is connected to the sidewall 30 by having the outer perimeter of the base 10 folded up and having the outer surface coating of the base's outer perimeter melted together with the inner surface coating of the sidewall 30. The sidewall 30 comprises a rolled upper edge. The sidewall 30 comprises the circumferential extension 31 parallel to the base 10 at a position between the rolled upper edge and the bottom portion. The top 20 is connected to the lid 1 by having the inner surface coating of the circumferential extension melted together with the outer perimeter coating of the top 20.

Figure 13:
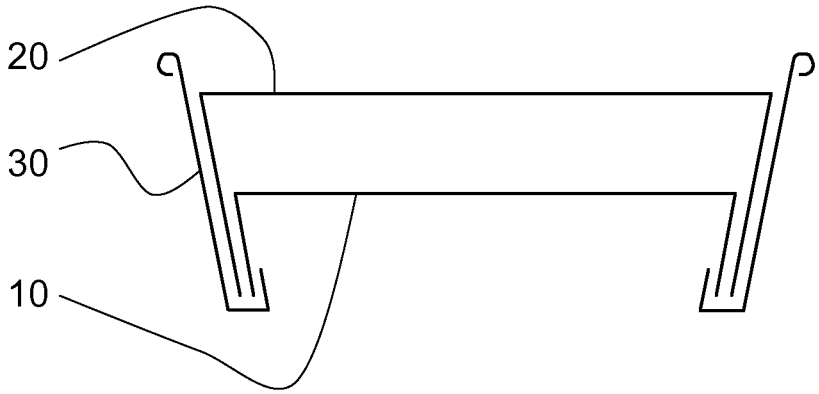
FIG. 13 illustrates schematically a cross-sectional view of one exemplary embodiment of the lid.

FIG. 13 illustrates schematically a cross-sectional view of one exemplary embodiment of the lid 1. In this example, the outer perimeter of the base 10 is folded down, and the outer perimeter of the top 20 is folded down. The inner surface coating of the top's outer perimeter is melted together with the outer surface coating of the base's outer perimeter, wherein horizontal portions of the base 10 and the top 20 are at a distance within each other. The top 20 is connected to the sidewall 30 by having the outer surface coating of the top's outer perimeter melted together with the inner surface coating of the sidewall 30. The bottom portion of the sidewall 30 is folded around the edge of the outer perimeter of the top 20 facing down and the edge of the outer perimeter of the base 10 facing down. In this embodiment, the base 10 and the top 20 provide stiffness to the sidewall 30.

Figure 14:
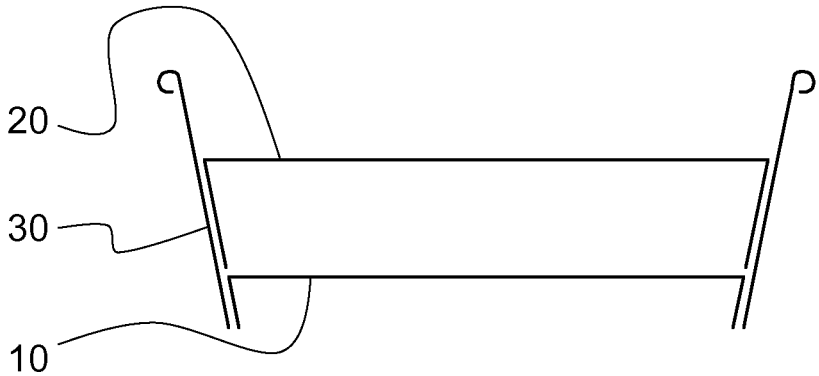
FIG. 14 illustrates schematically a cross-sectional view of one exemplary embodiment of the lid.

FIG. 14 illustrates schematically a cross-sectional view of one exemplary embodiment of the lid 1. In this example, the outer perimeter of the base 10 is folded down and the outer perimeter of the top 20 is folded down. The top 20 is connected to the sidewall 30 by having the outer surface coating of the top's outer perimeter melted together with the inner surface coating of the sidewall 30. The base 10 is connected to the sidewall 30 by having the outer surface coating of the base's outer perimeter melted together with the inner surface coating of the sidewall 30.

Figure 15:
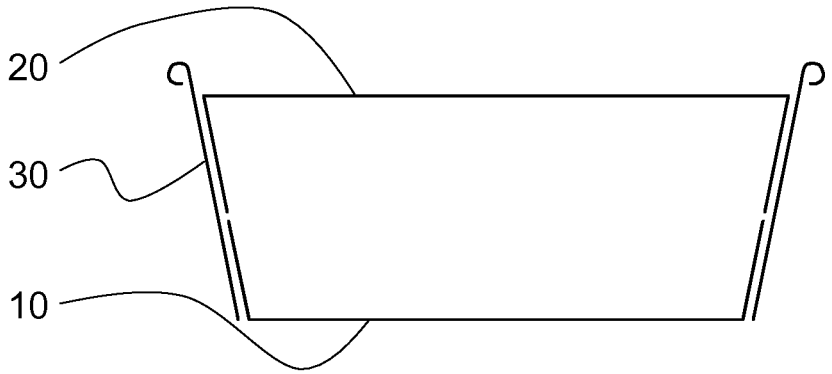
FIG. 15 illustrates schematically a cross-sectional view of one exemplary embodiment of the lid.

FIG. 15 illustrates schematically a cross-sectional view of one exemplary embodiment of the lid 1. In this example, the outer perimeter of the base 10 is folded up and the outer perimeter of the top 20 is folded down, wherein the edges of the base 10 and the top are abutting. The top 20 is connected to the sidewall 30 by having the outer surface coating of the top's outer perimeter melted together with the inner surface coating of the sidewall 30. The base 10 is connected to the sidewall 30 by having the outer surface coating of the base's outer perimeter melted together with the inner surface coating of the sidewall 30.

Figure 16:
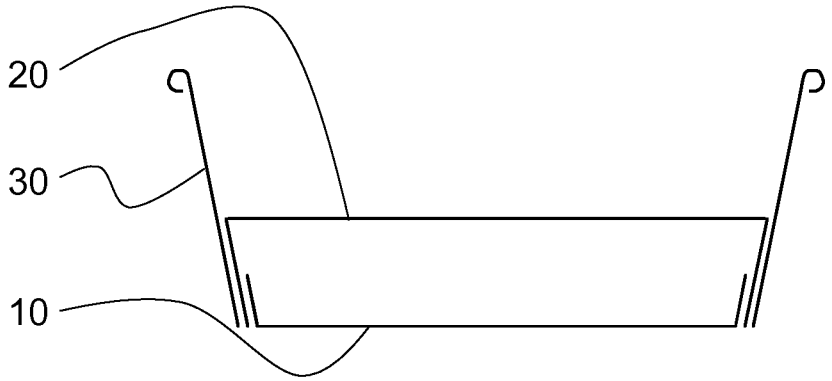
FIG. 16 illustrates schematically a cross-sectional view of one exemplary embodiment of the lid.

FIG. 16 illustrates schematically a cross-sectional view of one exemplary embodiment of the lid 1. In this example, the outer perimeter of the base 10 is folded up. The outer perimeter of the top 20 is folded down and positioned overlapping with the edge of the base 10. The inner surface coating of the top's outer perimeter is melted together with the outer surface coating of the base's outer perimeter, wherein horizontal portions of the base 10 and the top 20 are at a distance within each other. The top 20 is connected to the sidewall 30 by having the outer surface coating of the top's outer perimeter melted together with the inner surface coating of the sidewall 30.

Figure 17:
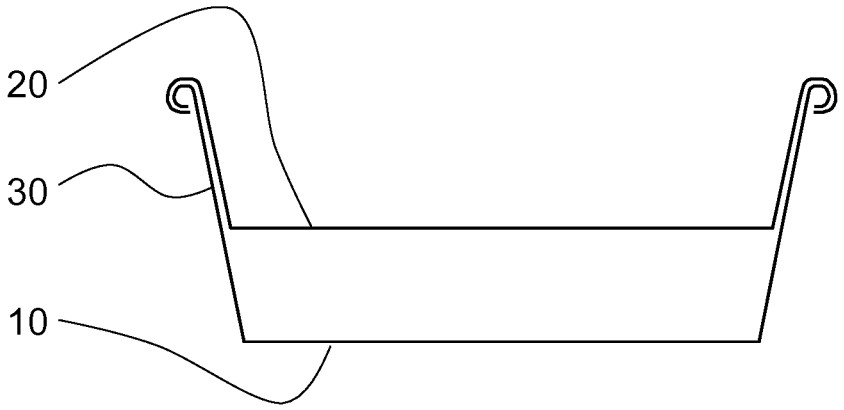
FIG. 17 illustrates schematically a cross-sectional view of one exemplary embodiment of the lid.
Figure 18:
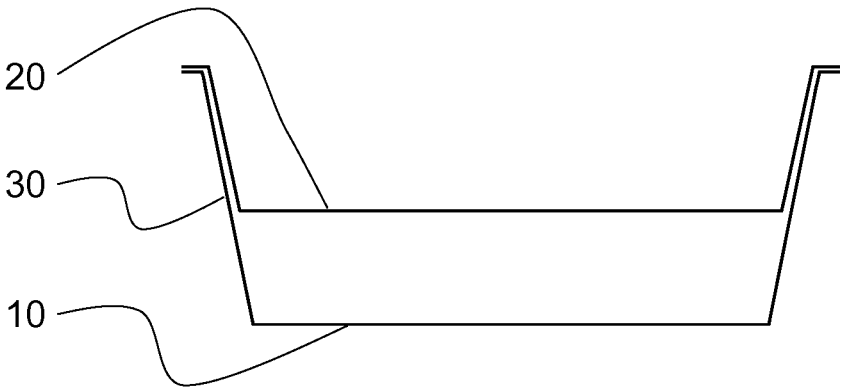
FIG. 18 illustrates schematically a cross-sectional view of one exemplary embodiment of the lid.

FIG. 17 illustrates schematically a cross-sectional view of one exemplary embodiment of the lid 1. In this example, the outer perimeter of the base 10 is folded up to form an outer portion of the sidewall 30. The outer perimeter of the top 20 is folded up to form an inner portion of the sidewall 30. The base 10 and the top 20 are connected by having the inner surface coating of the newly formed outer portion of the sidewall 30 melted together with the outer surface coating of the inner portion of the newly formed sidewall 30. In FIG. 17 the upper edges of the base 10 and the top 20 are rolled together. FIG. 18 provides an alternative solution for the upper edges, as in that embodiment the upper edges are folded out.

Figure 19:
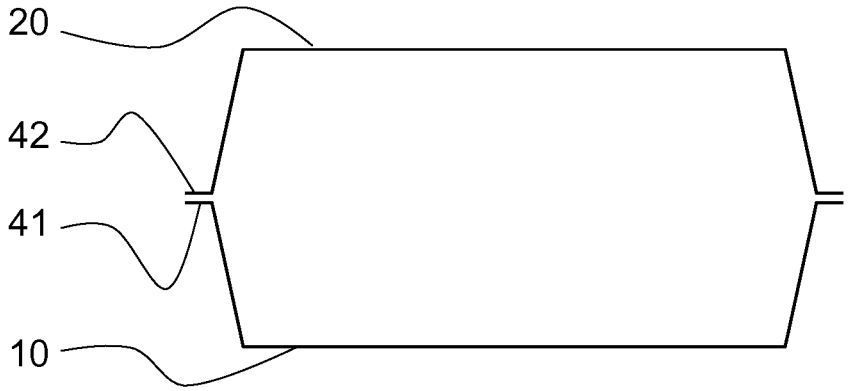
FIG. 19 illustrates schematically a cross-sectional view of one exemplary embodiment of the lid.

FIG. 19 illustrates schematically a cross-sectional view of one exemplary embodiment of the lid 1. In this example, a first portion of an outer perimeter of the base 10 is folded up to form a lower portion of the sidewall 30. A second portion of the outer perimeter of the base 10 is folded out to form a first horizontal flange 41 to the edge of the base 10. A first portion of an outer perimeter of the top 20 is folded down to form an upper portion of the sidewall 30. A second portion of the outer perimeter of the top 20 is folded out to form a second horizontal flange 42 to the edge of the top 20. The base and the top 20 are connected by having a lower surface coating of the second horizontal flange 42 melted together with an upper surface coating of the first horizontal flange 41.

Figure 20:
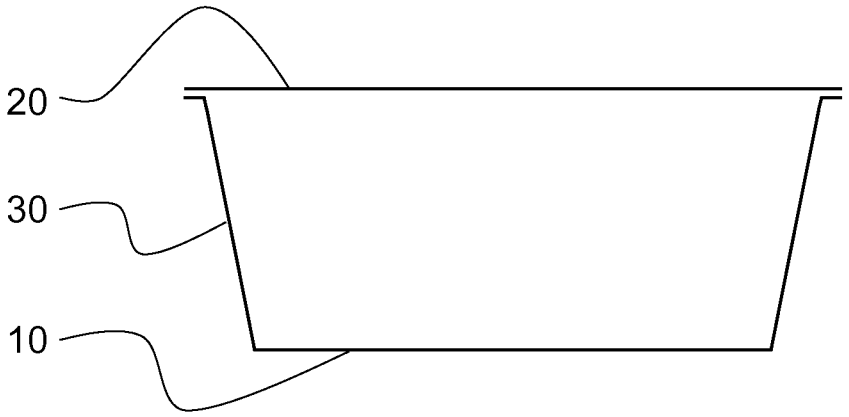
FIG. 20 illustrates schematically a cross-sectional view of one exemplary embodiment of the lid.

FIG. 20 illustrates schematically a cross-sectional view of one exemplary embodiment of the lid 1. In this example, the first portion of an outer perimeter of the base 10 is folded up to form the sidewall 30. The second portion of the outer perimeter of the base 10 is folded out to form the first horizontal flange 41 to the edge of the base 10. The top 20 is flat and disc-shaped, having the lower surface coating of the outer perimeter melted together with the upper surface coating of the first horizontal flange 41.

Figure 21:
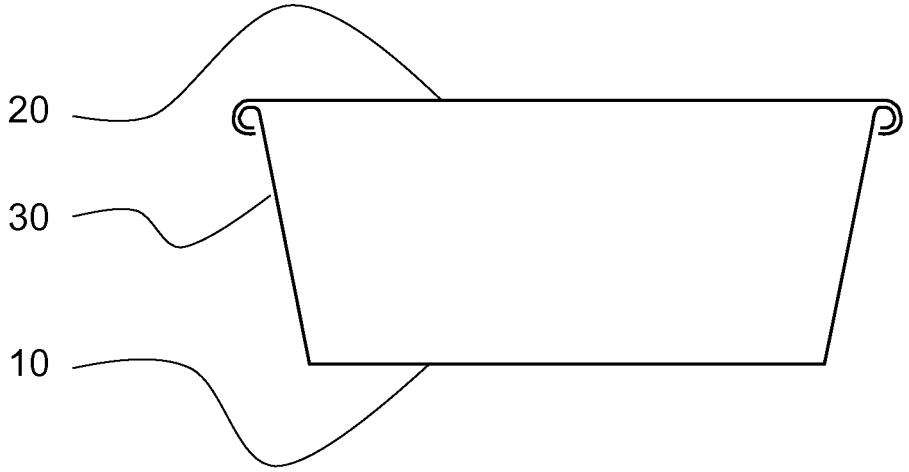
FIG. 21 illustrates schematically a cross-sectional view of one exemplary embodiment of the lid.

FIG. 21 illustrates schematically a cross-sectional view of one exemplary embodiment of the lid 1. In this example, the first portion of an outer perimeter of the base 10 is folded up to form the sidewall 30. The top 20 is connected to the lid 1 by having an upper edge of the sidewall 30 rolled together with an outer perimeter of the top 20. Additionally, the coatings may be melted together.

Figure 22:
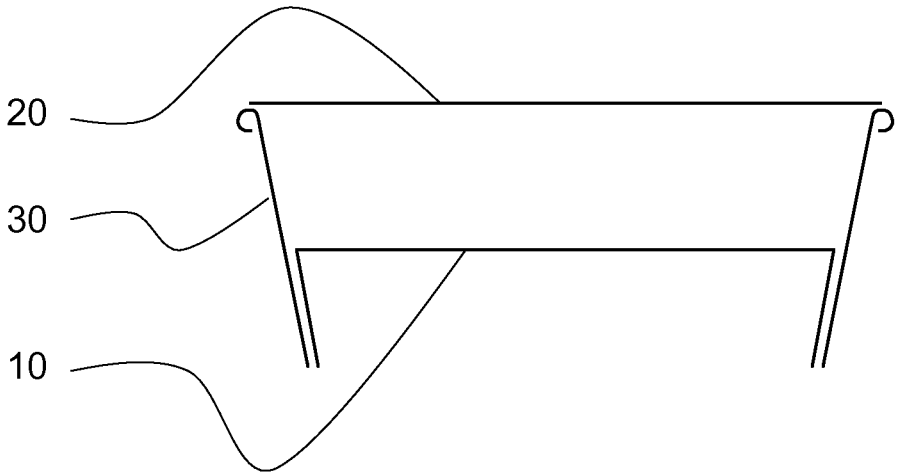
FIG. 22 illustrates schematically a cross-sectional view of one exemplary embodiment of the lid.

FIG. 22 illustrates schematically a cross-sectional view of one exemplary embodiment of the lid 1. The base 10 is connected to the sidewall 30 by having the outer perimeter of the base 10 folded down. The outer surface coating of the base's 10 outer perimeter is melted together with the inner surface coating of the sidewall 30. The upper edge of the sidewall 30 is rolled. The top 20 is connected to the lid 1 by having the sidewall 30 surface coating facing up melted together with the lower outer perimeter surface coating of the top 20. In this embodiment, the top 20 is flat and disc-shaped.

Figure 23:
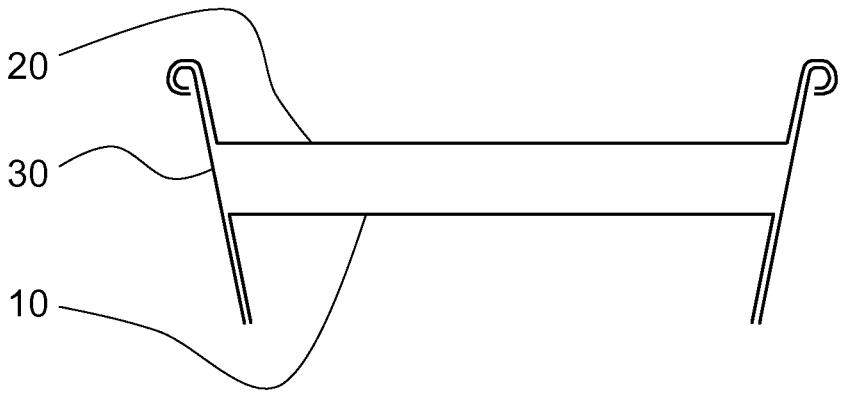
FIG. 23 illustrates schematically a cross-sectional view of one exemplary embodiment of the lid.

FIG. 23 illustrates schematically a cross-sectional view of one exemplary embodiment of the lid 1. The outer perimeter of the base 10 is folded down to form the lower portion of the inner portion of the sidewall 30, together with the sidewall 30. The outer perimeter of the top 20 is folded up to form an upper portion of the inner portion of the sidewall 30, together with the sidewall 30. The inner surface coating of the outer portion of the sidewall 30 is melted together with the outer surface coatings of both the upper and lower portions of the inner portion of the sidewall 30. The upper edge of the outer portion of the sidewall 30 and the inner portion of the sidewall are rolled together.

Figure 24:
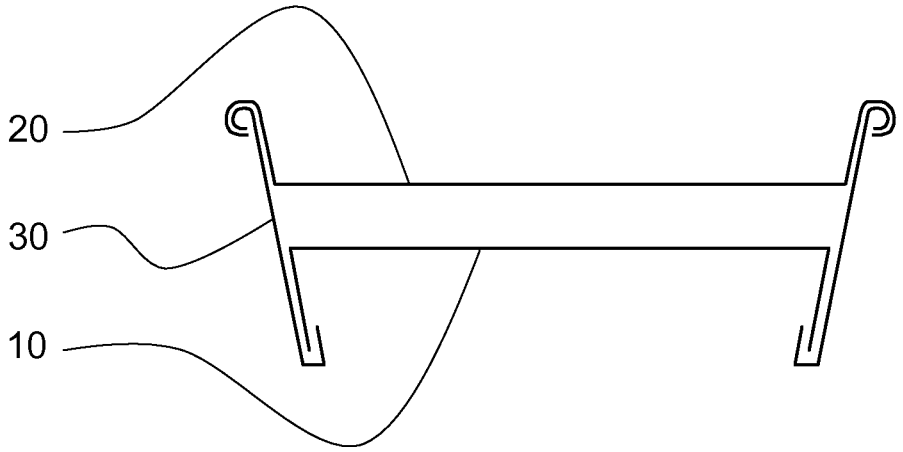
FIG. 24 illustrates schematically a cross-sectional view of one exemplary embodiment of the lid.

FIG. 24 illustrates schematically a cross-sectional view of one exemplary embodiment of the lid 1. The outer perimeter of the base 10 is folded down to form a lower portion of an inner portion of the sidewall 30, together with the sidewall 30. The outer perimeter of the top 20 is folded up to form an upper portion of the inner portion of the sidewall 30, together with the sidewall 30. The inner surface coating of the outer portion of the sidewall 30 is melted together with the outer surface coatings of both the upper and lower portions of the inner portion of the sidewall 30. The bottom portion of the outer sidewall 30 is folded around the edge of the outer perimeter of the base 10. The folding around the edge reinforces the lower portion of the lid 1.

Figure 25:
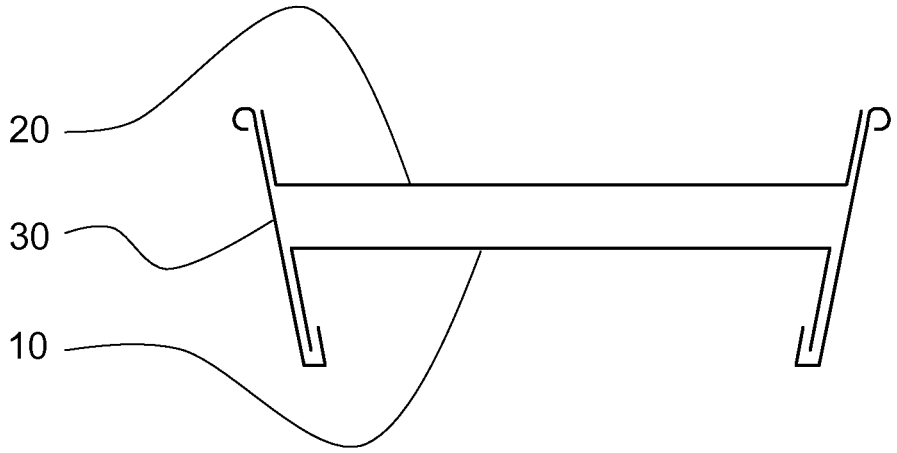
FIG. 25 illustrates schematically a cross-sectional view of one exemplary embodiment of the lid.

FIG. 25 illustrates schematically a cross-sectional view of one exemplary embodiment of the lid 1. The outer perimeter of the base 10 is folded down to form the lower portion of the inner portion of the sidewall 30, together with the sidewall 30. The inner surface coating of the outer portion of the sidewall 30 is melted together with the outer surface coating of the inner portion of the sidewall 30. The bottom portion of the outer sidewall 30 is folded around an edge of the outer perimeter of the base 10. The top 20 is connected to the lid 1 by having an upper edge of the sidewall 30 rolled and having the sidewall 30 surface coating facing up melted together with a lower outer perimeter surface coating of the top 20.

Figure 26:
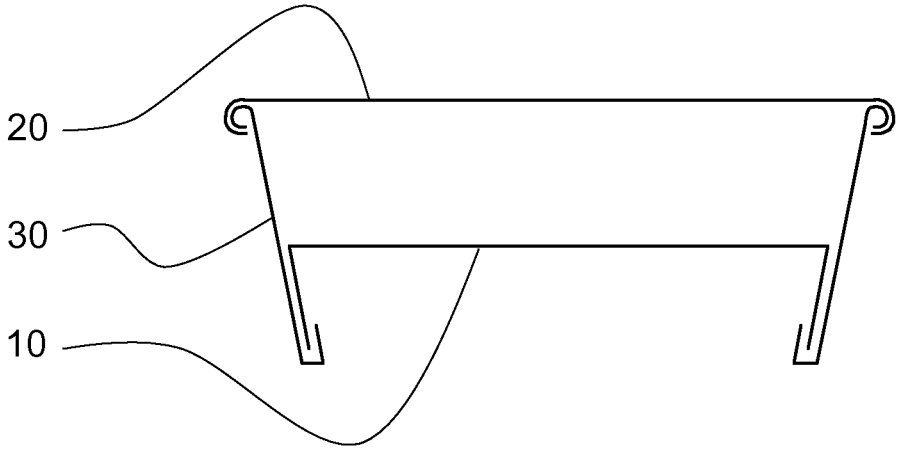
FIG. 26 illustrates schematically a cross-sectional view of one exemplary embodiment of the lid.
Figure 27:
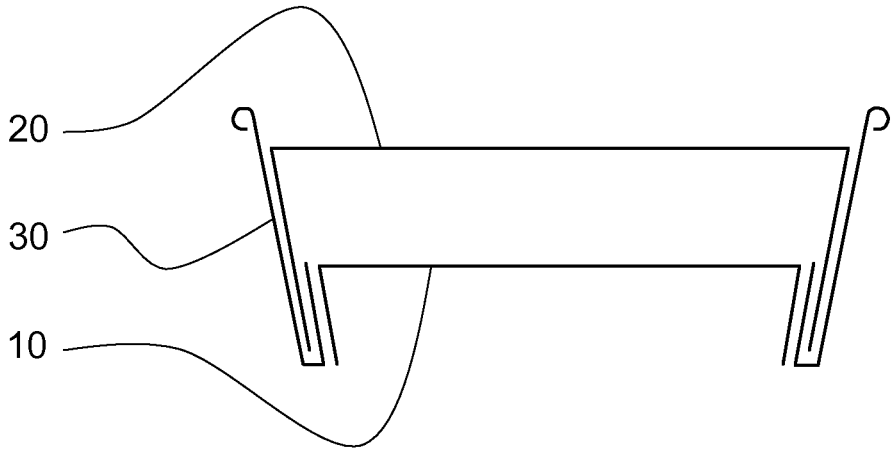
FIG. 27 illustrates schematically a cross-sectional view of one exemplary embodiment of the lid.

FIG. 26 illustrates schematically a cross-sectional view of one exemplary embodiment of the lid 1. The outer perimeter of the base 10 is folded down to form the lower portion of the inner portion of the sidewall 30, together with the sidewall 30. The inner surface coating of the outer portion of the sidewall 30 is melted together with the outer surface coating of the inner portion of the sidewall 30. The bottom portion of the outer sidewall 30 is folded around an edge of the outer perimeter of the base 10. The top 20 is connected to the lid 1 by having an upper edge of the sidewall 30 rolled together with the outer perimeter of the top 20.

FIG. 26 illustrates schematically a cross-sectional view of one exemplary embodiment of the lid 1. The outer perimeter of the top 20 is folded down to form an inner portion of the sidewall. The inner surface coating of the outer portion of the sidewall 30 is melted together with an outer surface coating of the inner portion of the sidewall. The bottom portion of the outer sidewall 30 is folded around the edge of the outer perimeter of the top 20. The outer perimeter of the base 10 is folded down. The sidewall 30 surface coating facing inside is melted together with the outer perimeter surface coating of the base 10. In this embodiment, the bottom portion of the sidewall 30 comprises four layers.

Figure 28:
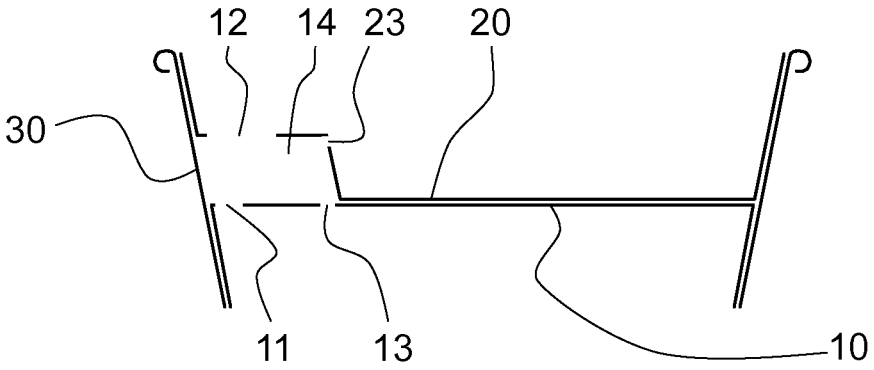
FIG. 28 illustrates schematically a cross-sectional view of one exemplary embodiment of the lid.
Figure 29:
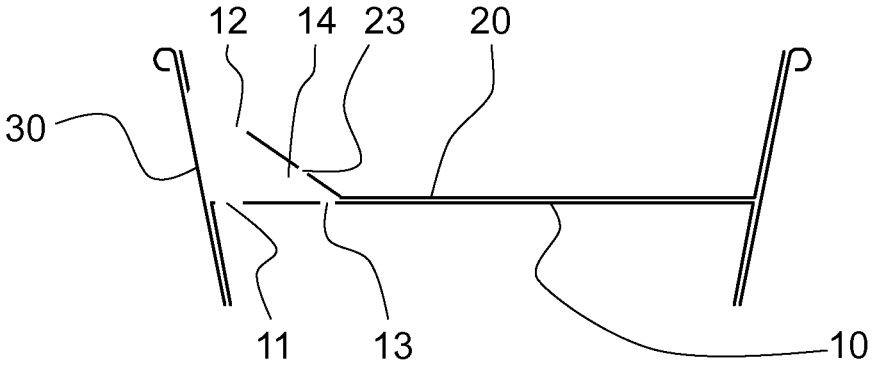
FIG. 29 illustrates schematically a cross-sectional view of one exemplary embodiment of the lid.

FIG. 28 illustrates schematically a cross-sectional view of one exemplary embodiment of the lid 1, wherein a horizontal portion of the base 10 is partially connected to a horizontal portion of the top 20. The chamber 14 occupies the lid 1 partially. The chamber 14 may comprise various shapes to further enhance the splash resistance. In FIG. 29 the top 20 is connected to the sidewall 30 diagonally, providing the sectional shape of the chamber 14 to be triangular. The first opening 11 and the second opening 12 are placed at the outer perimeter. The first breather opening 13 and/or the second breather opening 23 are placed at a central region of the chamber 14. The chamber 14 may be shaped to accommodate the first breather opening 13 and/or the second breather opening 23 to a suitable distance from the first opening 11 and the second opening 12.

Figure 30:
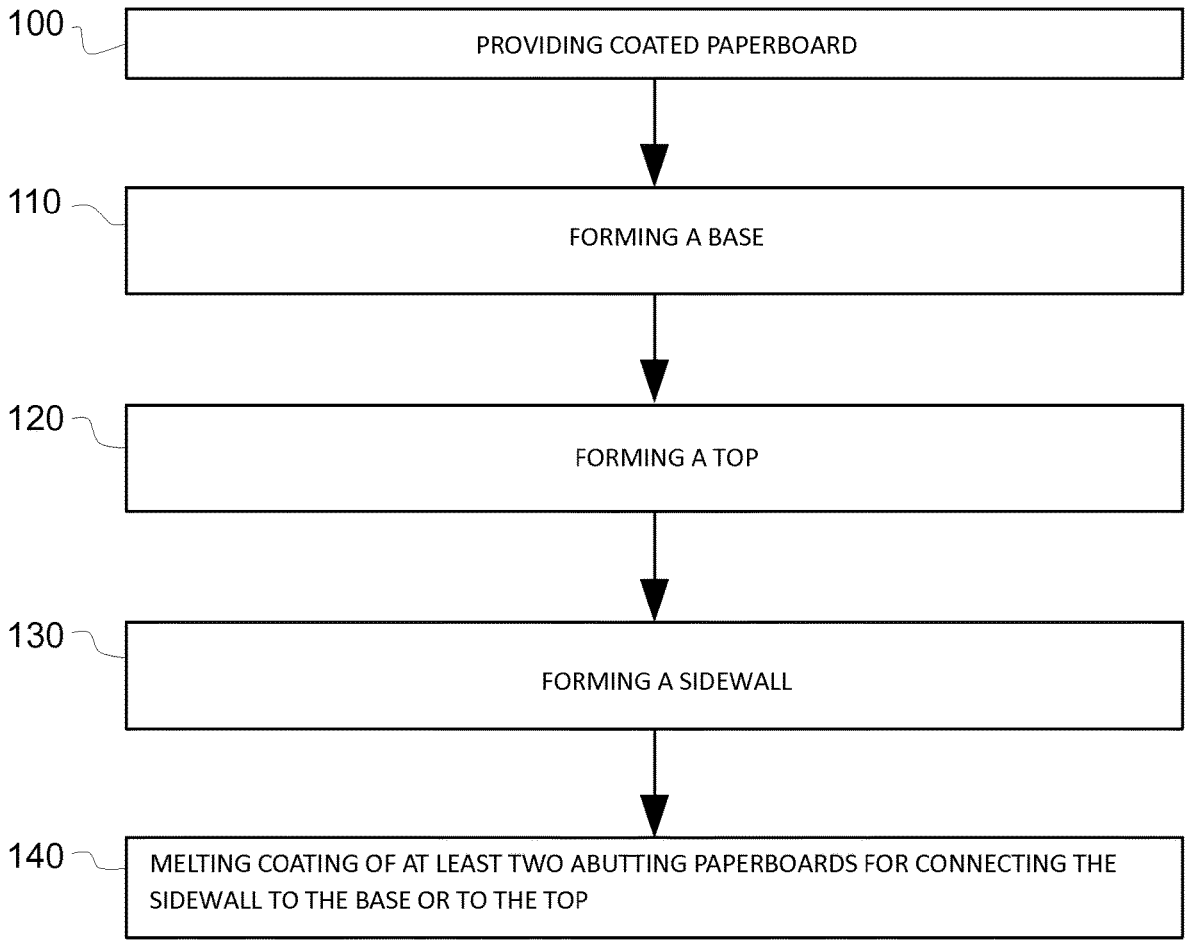
FIG. 30 illustrates as a flowchart steps of a method for manufacturing the lid.

FIG. 30 illustrates exemplary steps of the method in a flowchart. Step 100 comprises providing coated paperboard. Step 110 comprises forming the base 100. Step 120 comprises forming the top 120 Step 130 comprises forming the sidewall 140. The forming steps comprise cutting the paperboard into suitable shape. Paperboards may be coated on one side or on both sides. The suitable side is selected for each element, the base 10, the top 20 and the sidewall 30. In some embodiments, the sidewall 30 is formed from the base 10 or from the top 20. Step 140 comprises melting coating of at least two connecting or abutting paperboards for connecting the sidewall 30 to the base 10 or to the top 20. Order of the steps may vary in different embodiments.

A lid for a beverage cup is disclosed herein, comprising: a base comprising a first opening; a top comprising a second opening near an edge of the top; a sidewall connected to the circumference of the top and the base; a chamber being defined by the base, the top and the sidewall; and the lid is made of coated paperboard. A beverage is configured to flow from the beverage cup, through the first opening, through the chamber and through the second opening to the user drinking the beverage. The sidewall is connected to the base or to the top by a melted coating of the paperboard. In one embodiment, the lid comprises a vertical axis along the base and the top; and the first opening and the second opening are at different positions along the vertical axis. In one embodiment, the lid comprises a vertical axis along the base and the top; and the first opening and the second opening are partially aligned along the vertical axis. In one embodiment, the chamber comprises an infusion material for the beverage configured to flow though the chamber. In one embodiment, the chamber comprises substance configured to flow through the second opening with the beverage. In one embodiment, the first opening is covered by a first tear-off cover. In one embodiment, the second opening is covered by a second tear-off cover. In one embodiment, the coated paperboard comprises a coated barrier board. In one embodiment, the coated barrier comprises a water-based dispersion coating. In one embodiment, the coating comprises at least one substance from the group of polyethylene, low density polyethylene, biopolyethylene, microfibrillated cellulose, polyhydroxyalkanoate and polylactic acid. In one embodiment, the base comprises a first breather opening at a distal edge from the first opening. In one embodiment, the top comprises a second breather opening at a distal edge from the second opening, near a user's nose when the user is drinking though the lid, configured to allow air to pass through the second breather opening. In one embodiment, the base comprises a mesh configured to allow liquid from the beverage cup to pass through the base. In one embodiment, a horizontal portion of the base is partially connected to a horizontal portion of the top. In one embodiment, an outer perimeter of the top is folded down and a bottom portion of the sidewall is folded around an edge of an outer perimeter of the top facing down. In one embodiment, the top is connected to the sidewall by having an outer perimeter of the top folded down and having an outer surface coating of the top's outer perimeter melted together with an inner surface coating of the sidewall; and the base is connected to the lid by having an edge surface facing down of the connected top and sidewall coating melted together with an upper coating of the base's outer perimeter. In one embodiment, the top is connected to the sidewall by having an outer perimeter of the top folded down and having an outer surface coating of the top's outer perimeter melted together with an inner surface coating of the sidewall; a bottom portion of the sidewall is folded around an edge of an outer perimeter of the top facing down; and the base is connected to the lid by having a sidewall surface coating facing down melted together with an upper portion of an outer perimeter surface coating of the base. In one embodiment, the base is connected to the sidewall by having an outer perimeter of the base folded down and having an outer surface coating of the base's outer perimeter melted together with an inner surface coating of the sidewall; a bottom portion of the sidewall is folded around the edge of the outer perimeter of the base facing down; and the top is connected to the lid by having an upper edge of the sidewall rolled; and having a sidewall surface coating facing up melted together with a lower outer perimeter surface coating of the top. In one embodiment, the base is connected to the sidewall by having an outer perimeter of the base folded down and having an outer surface coating of the base's outer perimeter melted together with an inner surface coating of the sidewall; and the top is connected to the lid by having an upper edge of the sidewall rolled together with an outer perimeter of the top. In one embodiment, the base is connected to the sidewall by having an outer perimeter of the base folded up and having an outer surface coating of the base's outer perimeter melted together with an inner surface coating of the sidewall; and the top is connected to the lid by having an upper edge of the sidewall rolled together with an outer perimeter of the top. In one embodiment, the base is connected to the sidewall by having an outer perimeter of the base folded up and having an outer surface coating of the base's outer perimeter melted together with an inner surface coating of the sidewall; and the top is connected to the lid by having an upper edge of the base melted together with an outer perimeter of the top. In one embodiment, the base is connected to the sidewall by having an outer perimeter of the base folded down and having an outer surface coating of the base's outer perimeter melted together with an inner surface coating of the sidewall; a bottom portion of the sidewall is folded around the edge of the outer perimeter of the base facing down; the sidewall comprises a rolled upper edge; the sidewall comprises a circumferential extension parallel to the base at a position between the rolled upper edge and the bottom portion; the top is connected to the lid by having an inner surface coating of the circumferential extension melted together with an outer perimeter surface coating of the top. In one embodiment, the base is connected to the sidewall by having an outer perimeter of the base folded up and having an outer surface coating of the base's outer perimeter melted together with an inner surface coating of the sidewall; the sidewall comprises a rolled upper edge; the sidewall comprises a circumferential extension parallel to the base at a position between the rolled upper edge and the bottom portion; the top is connected to the lid by having an inner surface coating of the circumferential extension melted together with an outer perimeter coating of the top. In one embodiment, an outer perimeter of the base is folded down; an outer perimeter of the top is folded down; an inner surface coating of the top's outer perimeter is melted together with an outer surface coating of the base's outer perimeter, wherein horizontal portions of the base and the top are at a distance within each other; the top is connected to the sidewall by having an outer surface coating of the top's outer perimeter melted together with an inner surface coating of the sidewall; In one embodiment, a bottom portion of the sidewall is folded around an edge of the outer perimeter of the top facing down and an edge of the outer perimeter of the base facing down. In one embodiment, an outer perimeter of the base is folded down; an outer perimeter of the top is folded down; the top is connected to the sidewall by having an outer surface coating of the top's outer perimeter melted together with an inner surface coating of the sidewall; and the base is connected to the sidewall by having an outer surface coating of the base's outer perimeter melted together with the inner surface coating of the sidewall. In one embodiment, an outer perimeter of the base is folded up; an outer perimeter of the top is folded down; the top is connected to the sidewall by having an outer surface coating of the top's outer perimeter melted together with an inner surface coating of the sidewall; and the base is connected to the sidewall by having an outer surface coating of the base's outer perimeter melted together with the inner surface coating of the sidewall. In one embodiment, an outer perimeter of the base is folded up; an outer perimeter of the top is folded down; inner surface coating of the top's outer perimeter is melted together with an outer surface coating of the base's outer perimeter, wherein horizontal portions of the base and the top are at a distance within each other; the top is connected to the sidewall by having an outer surface coating of the top's outer perimeter melted together with an inner surface coating of the sidewall. In one embodiment, an outer perimeter of the base is folded up to form an outer portion of the sidewall; an outer perimeter of the top is folded up to form an inner portion of the sidewall; and having an inner surface coating of the outer portion of the sidewall melted together with an outer surface coating of the inner portion of the sidewall. In one embodiment, a first portion of an outer perimeter of the base is folded up to form a lower portion of the sidewall; a second portion of the outer perimeter of the base is folded out to form a first horizontal flange to the edge of the base; a first portion of an outer perimeter of the top is folded down to form an upper portion of the sidewall; a second portion of the outer perimeter of the top is folded out to form a second horizontal flange to the edge of the top; and having a lower surface coating of the second horizontal flange melted together with an upper surface coating of the first horizontal flange. In one embodiment, a first portion of an outer perimeter of the base is folded up to form the sidewall; a second portion of the outer perimeter of the base is folded out to form a first horizontal flange to the edge of the base; and the top is flat and disc-shaped, having a lower surface coating of an outer perimeter melted together with an upper surface coating of the first horizontal flange. In one embodiment, a first portion of an outer perimeter of the base is folded up to form the sidewall; and the top is connected to the lid by having an upper edge of the sidewall rolled together with an outer perimeter of the top. In one embodiment, the base is connected to the sidewall by having an outer perimeter of the base folded down and having an outer surface coating of the base's outer perimeter melted together with an inner surface coating of the sidewall; and the top is connected to the lid by having an upper edge of the sidewall rolled; and having a sidewall surface coating facing up melted together with a lower outer perimeter surface coating of the top. In one embodiment, an outer perimeter of the base is folded down to form a lower portion of an inner portion of the sidewall; an outer perimeter of the top is folded up to form an upper portion of the inner portion of the sidewall; having an inner surface coating of the outer portion of the sidewall melted together with an outer surface coatings of both the upper and lower portions of the inner portion of the sidewall; and having an upper edge of the outer portion of the sidewall and the inner portion of the sidewall rolled together. In one embodiment, an outer perimeter of the base is folded down to form a lower portion of an inner portion of the sidewall; an outer perimeter of the top is folded up to form an upper portion of the inner portion of the sidewall; having an inner surface coating of the outer portion of the sidewall melted together with an outer surface coatings of both the upper and lower portions of the inner portion of the sidewall; and a bottom portion of the outer sidewall is folded around an edge of the outer perimeter of the base. In one embodiment, an outer perimeter of the base is folded down to form a lower portion of an inner portion of the sidewall; having an inner surface coating of the outer portion of the sidewall melted together with an outer surface coating of the inner portion of the sidewall; a bottom portion of the outer sidewall is folded around an edge of the outer perimeter of the base; and the top is connected to the lid by having an upper edge of the sidewall rolled; and having a sidewall surface coating facing up melted together with a lower outer perimeter surface coating of the top. In one embodiment, an outer perimeter of the top is folded down to form an inner portion of the sidewall; having an inner surface coating of the outer portion of the sidewall melted together with an outer surface coating of the inner portion of the sidewall; a bottom portion of the outer sidewall is folded around an edge of the outer perimeter of the top; and the outer perimeter of the base is folded down; and having a sidewall surface coating facing inside melted together with the outer perimeter surface coating of the base.

Alternatively, or in addition, a method for manufacturing a lid for a beverage cup is disclosed herein. The lid comprises: a base comprising a first opening; a top comprising a second opening near an edge of the top; a sidewall connected to the circumference of the top and the base; a chamber being defined by the base, the top and the sidewall; and the lid is made of coated paperboard, wherein a beverage is configured to flow from the beverage cup, through the first opening, through the chamber and through the second opening to the user drinking the beverage. The method comprises the step of melting coating of at least two connecting paperboards for connecting the sidewall to the base or to the. In one embodiment, the method comprises the step of placing into the chamber an infusion material for the beverage configured to flow though the chamber. In one embodiment, the method comprises the step of placing into the chamber a substance configured to flow through the second opening with the beverage. In one embodiment, the coated paperboard comprises a coated barrier board. In one embodiment, the coated barrier comprises a water-based dispersion coating. In one embodiment, the coating comprises at least one substance from the group of polyethylene, low density polyethylene, biopolyethylene, microfibrillated cellulose, polyhydroxyalkanoate and polylactic acid. In one embodiment, the method comprises partially connecting a horizontal portion of the base to a horizontal portion of the top. In one embodiment, the method comprises folding down an outer perimeter of the top and folding a bottom portion of the sidewall around an edge of an outer perimeter of the top facing down. In one embodiment, the method comprises the steps of connecting the top to the sidewall by folding down an outer perimeter of the top and melting together an outer surface coating of the top's outer perimeter and an inner surface coating of the sidewall; and connecting the base to the lid by melting together an edge surface facing down of the connected top and sidewall coating, and an upper coating of the base's outer perimeter. In one embodiment, the method comprises the steps of connecting the top to the sidewall by folding down an outer perimeter of the top and melting together an outer surface coating of the top's outer perimeter and an inner surface coating of the sidewall; folding a bottom portion of the sidewall around an edge of an outer perimeter of the top facing down; and connecting the base to the lid by melting together a sidewall surface coating facing down and an upper portion of an outer perimeter surface coating of the base. In one embodiment, the method comprises the steps of connecting the base to the sidewall by folding down an outer perimeter of the base and melting together an outer surface coating of the base's outer perimeter and an inner surface coating of the sidewall; folding a bottom portion of the sidewall around the edge of the outer perimeter of the base facing down; and connecting the top to the lid by rolling an upper edge of the sidewall rolled; and melting together a sidewall surface coating facing up and a lower outer perimeter surface coating of the top. In one embodiment, the method comprises the steps of connecting the base to the sidewall by folding down an outer perimeter of the base and melting together an outer surface coating of the base's outer perimeter and an inner surface coating of the sidewall; and connecting the top to the lid by rolling an upper edge of the sidewall together with an outer perimeter of the top. In one embodiment, the method comprises the steps of connecting the base to the sidewall by folding up an outer perimeter of the base and melting together an outer surface coating of the base's outer perimeter and an inner surface coating of the sidewall; and connecting the top to the lid by rolling an upper edge of the sidewall together with an outer perimeter of the top. In one embodiment, the method comprises the steps of connecting the base to the sidewall by folding up an outer perimeter of the base and melting together an outer surface coating of the base's outer perimeter and an inner surface coating of the sidewall; and connecting the top to the lid by melting together an upper edge of the base and an outer perimeter of the top. In one embodiment, the method comprises the steps of connecting the base to the sidewall by folding an outer perimeter of the base down and melting together an outer surface coating of the base's outer perimeter and an inner surface coating of the sidewall; folding a bottom portion of the sidewall around the edge of the outer perimeter of the base facing down; rolling an upper edge of the sidewall; pressing to the sidewall a circumferential extension parallel to the base at a position between the rolled upper edge and the bottom portion; connecting the top to the lid by melting together an inner surface coating of the circumferential extension and an outer perimeter coating of the top. In one embodiment, the method comprises the steps of connecting the base to the sidewall by folding an outer perimeter of the base up and melting together an outer surface coating of the base's outer perimeter and an inner surface coating of the sidewall; rolling an upper edge of the sidewall; pressing to the sidewall a circumferential extension parallel to the base at a position between the rolled upper edge and the bottom portion; connecting the top to the lid by melting together an inner surface coating of the circumferential extension and an outer perimeter coating of the top. In one embodiment, the method comprises the steps of folding down an outer perimeter of the base; folding down an outer perimeter of the top; melting together an inner surface coating of the top's outer perimeter and an outer surface coating of the base's outer perimeter, wherein horizontal portions of the base and the top are at a distance within each other; connecting the top to the sidewall by melting together an outer surface coating of the top's outer perimeter and an inner surface coating of the sidewall; folding a bottom portion of the sidewall around an edge of the outer perimeter of the top facing down and an edge of the outer perimeter of the base facing down. In one embodiment, the method comprises the steps of folding an outer perimeter of the base down; folding an outer perimeter of the top down; connecting the top to the sidewall by melting together an outer surface coating of the top's outer perimeter and an inner surface coating of the sidewall; and connecting the base to the sidewall by melting together an outer surface coating of the base's outer perimeter and the inner surface coating of the sidewall. In one embodiment, the method comprises the steps of folding an outer perimeter of the base up; folding an outer perimeter of the top down; connecting the top to the sidewall by melting together an outer surface coating of the top's outer perimeter and an inner surface coating of the sidewall; and connecting the base to the sidewall by melting together an outer surface coating of the base's outer perimeter and the inner surface coating of the sidewall. In one embodiment, the method comprises the steps of folding an outer perimeter of the base up; folding an outer perimeter of the top down; melting together an inner surface coating of the top's outer perimeter and an outer surface coating of the base's outer perimeter, wherein horizontal portions of the base and the top are at a distance within each other; connecting the top to the sidewall by melting together an outer surface coating of the top's outer perimeter and an inner surface coating of the sidewall; and rolling together an upper edge of the top and an upper edge of the base. In one embodiment, the method comprises the steps of folding an outer perimeter of the base up to form an outer portion of the sidewall; folding an outer perimeter of the top up to form an inner portion of the sidewall; and melting together an inner surface coating of the outer portion of the sidewall and an outer surface coating of the inner portion of the sidewall. In one embodiment, the method comprises the steps of folding a first portion of an outer perimeter of the base up to form a lower portion of the sidewall; folding a second portion of the outer perimeter of the base out to form a first horizontal flange to the edge of the base; folding a first portion of an outer perimeter of the top down to form an upper portion of the sidewall; folding a second portion of the outer perimeter of the top out to form a second horizontal flange to the edge of the top; and melting together a lower surface coating of the second horizontal flange and an upper surface coating of the first horizontal flange. In one embodiment, the method comprises the steps of folding a first portion of an outer perimeter of the base up to form the sidewall; folding a second portion of the outer perimeter of the base out to form a first horizontal flange to the edge of the base; and the top is flat and disc-shaped, melting together a lower surface coating of an outer perimeter and an upper surface coating of the first horizontal flange. In one embodiment, the method comprises the steps of folding a first portion of an outer perimeter of the base up to form the sidewall; and connecting the top to the lid by rolling an upper edge of the sidewall rolled together with an outer perimeter of the top. In one embodiment, the method comprises the steps of connecting the base to the sidewall by folding an outer perimeter of the base down and melting an outer surface coating of the base's outer perimeter together with an inner surface coating of the sidewall; and connecting the top to the lid by rolling an upper edge of the sidewall; and melting a sidewall surface coating facing up together with a lower outer perimeter surface coating of the top. In one embodiment, the method comprises the steps of folding an outer perimeter of the base down to form a lower portion of an inner portion of the sidewall; folding an outer perimeter of the top up to form an upper portion of the inner portion of the sidewall; melting an inner surface coating of the outer portion of the sidewall together with an outer surface coatings of both the upper and lower portions of the inner portion of the sidewall; and rolling together an upper edge of the outer portion of the sidewall and the inner portion of the sidewall. In one embodiment, the method comprises the steps of folding an outer perimeter of the base down to form a lower portion of an inner portion of the sidewall; folding an outer perimeter of the top up to form an upper portion of the inner portion of the sidewall; melting an inner surface coating of the outer portion of the sidewall together with an outer surface coatings of both the upper and lower portions of the inner portion of the sidewall; and folding a bottom portion of the outer sidewall around an edge of the outer perimeter of the base. In one embodiment, the method comprises the steps of folding an outer perimeter of the base down to form a lower portion of an inner portion of the sidewall; melting an inner surface coating of the outer portion of the sidewall together with an outer surface coating of the inner portion of the sidewall; folding a bottom portion of the outer sidewall around an edge of the outer perimeter of the base; and the top is connected to the lid by having an upper edge of the sidewall rolled; and having a sidewall surface coating facing up melted together with a lower outer perimeter surface coating of the top. In one embodiment, the method comprises the steps of folding an outer perimeter of the top down to form an inner portion of the sidewall; melting an inner surface coating of the outer portion of the sidewall together with an outer surface coating of the inner portion of the sidewall; folding a bottom portion of the outer sidewall around an edge of the outer perimeter of the top; and folding the outer perimeter of the base down; and melting a sidewall surface coating facing inside together with the outer perimeter surface coating of the base.

Any range or device value given herein may be extended or altered without losing the effect sought.

Although at least a portion of the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

It will be understood that the benefits and advantages described above may relate to one embodiment or may relate to several embodiments. The embodiments are not limited to those that solve any or all of the stated problems or those that have any or all of the stated benefits and advantages. It will further be understood that any reference to 'an' item refers to one or more of those items.

The steps of the methods described herein may be carried out in any suitable order, or simultaneously where appropriate. Additionally, individual blocks may be deleted from any of the methods without departing from the spirit and scope of the subject matter described herein. Aspects of any of the examples described above may be combined with aspects of any of the other examples described to form further examples without losing the effect sought.

The term 'comprising' is used herein to mean including the method blocks or elements identified, but that such blocks or elements do not comprise an exclusive list and a method or apparatus may contain additional blocks or elements.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification.

The invention claimed is:

1. A lid for a beverage cup, comprising:

a base comprising a first opening;

a top comprising a second opening near an edge of the top;

a sidewall connected to the circumference of the top and the base;

a chamber being defined by the base, the top and the sidewall; and the lid is made of coated paperboard;

wherein a beverage is configured to flow from the beverage cup, through the first opening, through the chamber and through the second opening to the user drinking the beverage; and the sidewall is connected to the base or to the top by a melted coating of the paperboard;

wherein the top is connected to the sidewall by having an outer perimeter of the top folded down and having an outer surface coating of the top's outer perimeter melted together with an inner surface coating of the sidewall;

wherein a bottom portion of the sidewall is folded around an edge of an outer perimeter of the top facing down; and wherein the base is connected to the lid by having a sidewall surface coating facing down melted together with an upper portion of an outer perimeter surface coating of the base.

2. A lid for a beverage cup, comprising:

a base comprising a first opening; wherein the first opening is covered by a first tear-off cover;

a top comprising a second opening near an edge of the top;

a sidewall connected to the circumference of the top and the base;

a chamber being defined by the base, the top and the sidewall; and the lid is made of coated paperboard;

wherein a beverage is configured to flow from the beverage cup, through the first opening, through the chamber and through the second opening to the user drinking the beverage; and the sidewall is connected to the base or to the top by a melted coating of the paperboard;

wherein an outer perimeter of the base is folded up to form an outer portion of the sidewall;

wherein an outer perimeter of the top is folded up to form an inner portion of the sidewall; and having an inner surface coating of the outer portion of the sidewall melted together with an outer surface coating of the inner portion of the sidewall.

3. A lid for a beverage cup, comprising:

a base comprising a first opening;

a top comprising a second opening near an edge of the top;

a sidewall connected to the circumference of the top and the base;

a chamber being defined by the base, the top and the sidewall; and the lid is made of coated paperboard;

wherein a beverage is configured to flow from the beverage cup, through the first opening, through the chamber and through the second opening to the user drinking the beverage; and the sidewall is connected to the base or to the top by a melted coating of the paperboard;

wherein a first portion of an outer perimeter of the base is folded up to form the sidewall;

a second portion of the outer perimeter of the base is folded out to form a first horizontal flange to the edge of the base; and the top is flat and disc-shaped, having a lower surface coating of an outer perimeter melted together with an upper surface coating of the first horizontal flange.

4. A lid for a beverage cup, comprising:

a base comprising a first opening; wherein the first opening is covered by a first tear-off cover;

a top comprising a second opening near an edge of the top;

a sidewall connected to the circumference of the top and the base;

a chamber being defined by the base, the top and the sidewall; and the lid is made of coated paperboard;

wherein a beverage is configured to flow from the beverage cup, through the first opening, through the chamber and through the second opening to the user drinking the beverage; and the sidewall is connected to the base or to the top by a melted coating of the paperboard wherein a first portion of an outer perimeter of the base is folded up to form the sidewall; and the top is connected to the lid by having an upper edge of the sidewall rolled together with an outer perimeter of the top.

5. A lid for a beverage cup, comprising: a base comprising a first opening; wherein the first opening is covered by a first tear-off cover; a top comprising a second opening near an edge of the top a sidewall connected to the circumference of the top and the base;

a chamber being defined by the base, the top and the sidewall; and the lid is made of coated paperboard;

wherein a beverage is configured to flow from the beverage cup, through the first opening, through the chamber and through the second opening to the user drinking the beverage; and wherein the sidewall is connected to the base or to the top by a melted coating of the paperboard;

wherein an outer perimeter of the top is folded down to form an inner portion of the sidewall having an inner surface coating of the outer portion of the sidewall melted together with an outer surface coating of the inner portion of the sidewall;

wherein a bottom portion of the outer sidewall is folded around an edge of the outer perimeter of the top; and wherein the outer perimeter of the base is folded down; and having a sidewall surface coating facing inside melted together with the outer perimeter surface coating of the base.

6. A method for manufacturing a lid for a beverage cup, the lid comprising:

a base comprising a first opening;

a top comprising a second opening near an edge of the top;

a sidewall connected to the circumference of the top and the base;

a chamber being defined by the base, the top and the sidewall; and the lid is made of coated paperboard;

wherein a beverage is configured to flow from the beverage cup, through the first opening, through the chamber and through the second opening to the user drinking the beverage;

melting the coating of at least two connecting paperboards for connecting the sidewall to the base or to the top;

connecting the top to the sidewall by folding down an outer perimeter of the top and melting together an outer surface coating of the top's outer perimeter and an inner surface coating of the sidewall; and connecting the base to the lid by melting together an edge surface facing down of the connected top and sidewall coating, and an upper coating of the base's outer perimeter.

* * * * *